US009587184B2

(12) United States Patent
Joseck et al.

(10) Patent No.: US 9,587,184 B2
(45) Date of Patent: Mar. 7, 2017

(54) LUBRICANT BASE OIL HYDROPROCESSING AND BLENDING

(75) Inventors: Eric D. Joseck, Burke, VA (US); Michael Brian Carroll, Center Valley, PA (US); David Mentzer, Marshall, VA (US); Sara M. Berberich, Oakton, VA (US); Yogi V. Shukla, Cherry Hill, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 375 days.

(21) Appl. No.: 14/345,274

(22) PCT Filed: Sep. 21, 2011

(86) PCT No.: PCT/US2011/052531

§ 371 (c)(1), (2), (4) Date: Oct. 7, 2014

(87) PCT Pub. No.: WO2013/043164

PCT Pub. Date: Mar. 28, 2013

(65) Prior Publication Data

US 2015/0027925 A1 Jan. 29, 2015

(51) Int. Cl.
*C10G 65/14* (2006.01)
*C10G 65/00* (2006.01)
(Continued)

(52) U.S. Cl.
CPC ..... *C10G 65/14* (2013.01); *C10G 65/00* (2013.01); *C10G 65/12* (2013.01);
(Continued)

(58) Field of Classification Search
CPC ..... C10G 65/14; C10G 65/02; C10G 65/12; C10G 2300/302; C10G 2300/304
See application file for complete search history.

(56) References Cited

U.S. PATENT DOCUMENTS 3,763,033 A * 10/1973 Stauffer ..... C10G 45/00 208/18
6,295,485 B1 9/2001 Gleeson et al.
(Continued)

FOREIGN PATENT DOCUMENTS

EP 0471461 A2 2/1992

OTHER PUBLICATIONS

Johnson, Marvin F. L., "Estimation of the Zeolite Content of a Catalyst from Nitrogen Adsorption Isotherms," Journal of Catalysis, 1978, vol. 52, pp. 425-431.
(Continued)

*Primary Examiner* — Randy Boyer
*Assistant Examiner* — Juan Valencia
(74) *Attorney, Agent, or Firm* — Robert A. Migliorini

(57) ABSTRACT

Methods are provided for producing a plurality of lubricant base oil products with an increased overall yield. Prior to the final hydrocracking stage for viscosity index uplift, a feed for making a lubricant base oil is fractionated in order to form at least a feed for making a lighter lubricant base oil and a feed for making a heavier lubricant base oil. The fractionation cut points are selected to so that the feed fraction for forming a light lubricant base oil has a higher Noack volatility and a lower viscosity than the desired targets for the lighter lubricant base oil. The feed fractions are then hydroprocessed separately to achieve desired properties. After hydroprocessing, a portion of the heavier base oil is blended into the light lubricant base oil to produce a blended base oil product. This returns the volatility and the viscosity of the blended base oil to the desired specifications.

15 Claims, 2 Drawing Sheets

(51) Int. Cl.
*C10M 101/02* (2006.01)
*C10G 65/12* (2006.01)

(52) U.S. Cl.
CPC ..... *C10M 101/02* (2013.01); *C10G 2300/302* (2013.01); *C10G 2300/304* (2013.01); *C10G 2400/10* (2013.01)

(56) References Cited

U.S. PATENT DOCUMENTS

| | | | | |
|---|---|---|---|---|
| 7,642,095 | B2 | 1/2010 | Wang et al. | |
| 7,708,878 | B2 | 5/2010 | Rosenbaum et al. | |
| 2002/0189972 | A1* | 12/2002 | Benazzi ..... | C10G 65/12 208/57 |
| 2004/0222129 | A1 | 11/2004 | Aldous et al. | |
| 2006/0201851 | A1 | 9/2006 | Rosenbaum et al. | |

OTHER PUBLICATIONS

Billon, A. et al., "Consider Hydrorefining for Lubes," Hydrocarbon Processing, 1975, vol. 54, No. 9, pp. 139-144.

Cashmore, K. et al., "Hydrotreated Lube Oil Base Stocks," SAE Fuels Lubr. Meet, 1982, Toronto, Canada, spec. publ. n. SP-526, pp. 1-13.

Cranfield, J., "Japan Gets World's First Hydrotreating Lube Plant," Oil Gas Int, 1971, vol. 11, No. 5, pp. 70-72.

Farrell, T. et al., "Lube Facility Makes High-Quality Lube Oil From Low-Quality Feed," Oil & Gas Journal, 1986, vol. 84, No. 20, pp. 47-51.

* cited by examiner

LUBRICANT BASE OIL HYDROPROCESSING AND BLENDING

FIELD

This application provides a system and a method for hydroprocessing and blending of feedstocks to form lubricant base oils.

BACKGROUND

Hydrocracking of hydrocarbon feedstocks is often used to convert lower value hydrocarbon fractions into higher value products, such as conversion of vacuum gas oil (VGO) feedstocks to various fuels and lubricants. Typical hydrocracking reaction schemes can include an initial hydrotreatment step, a hydrocracking step, and a post hydrotreatment step, such as dewaxing or hydrofinishing. After these steps, the effluent can be fractionated to separate out a desired lubricant oil basestock.

One of the difficulties in lubricant base oil production is that hydroprocessing a lubricant feed to achieve desired lubricant base oil properties also results in conversion of a feed. The majority of molecules in a typical lubricant base oil have a boiling point greater than 370° C. In order to achieve desired properties, such as a reduced sulfur content or a higher viscosity index (VI), a feedstock is hydrotreated and/or hydrocracked to improve the feed properties. However, the improvement of feed properties is accompanied by conversion of a portion of the feed to molecules with a boiling point below 370° C. This results in a loss of yield for the lubricant base oil, as the converted molecules are more appropriate for use as a fuel.

European Patent EP 0471461 describes a method for producing low pour point and high viscosity index lubricant base oils by using solvent dewaxing. A low boiling waxy oil with a conventional viscosity index is blended with a high viscosity index, higher boiling oil. This blended oil is then dewaxed to a desired pour point. Because of the difference in boiling points, the low boiling waxy oil can then be separated out from higher boiling oil. The yield for the high viscosity index, higher boiling oil after solvent dewaxing of the blended oil to a desired pour point is increased relative to performing solvent dewaxing to the same pour point on only the higher boiling fraction.

U.S. Pat. No. 7,708,878 describes a system and method for generating lubricant base oils. After hydroprocessing of a feed, the hydroprocessed feed is subjected to two fractionations. A first portion of the hydroprocessed feed is fractionated in light block mode operation to produce a first set of base oil fractions. A second portion of the hydroprocessed feed is fractionated in medium block mode operation to produce a second set of base oil fractions. The first set and second set of base oil fractions can then be used to form various lubricant base oil products via blending.

SUMMARY

In an embodiment, a method for producing a lubricant base oil is provided. The method includes fractionating a feedstock to form at least a first feed fraction and a second feed fraction; hydroprocessing the first feed fraction to increase the viscosity index to at least about 85 and reduce the pour point to about −10° C. or less; hydroprocessing the second feed fraction to increase the viscosity index to at least about 80 and reduce the pour point to about −15° C. or less; fractionating the hydroprocessed first feed fraction to form a first product fraction having a viscosity at 100° C. of at least about 1.5 cSt and a Noack volatility of less than about 20.0; fractionating the hydroprocessed second feed fraction to form a second product fraction having a viscosity at 100° C. of about 5.0 cSt to about 12.0 cSt and a Noack volatility of about 5.0 to about 10.0; and blending a portion of the second hydroprocessed feed fraction with the first hydroprocessed feed fraction to form a blended product fraction, the blended product fraction comprising about 30 wt % or less of the second hydroprocessed feed fraction, the blended product fraction having a viscosity at 100° C. of about 2.0 cSt to about 5.0 cSt and a Noack volatility of about 10.0 to about 18.0, the viscosity of the blended product fraction at 100° C. being greater than the viscosity of the first hydroprocessed feed fraction by at least about 0.1 cSt, the Noack volatility of the blended product fraction being less than the Noack volatility of the first feedstock fraction by at least about 0.5.

DETAILED DESCRIPTION

Figure 1:
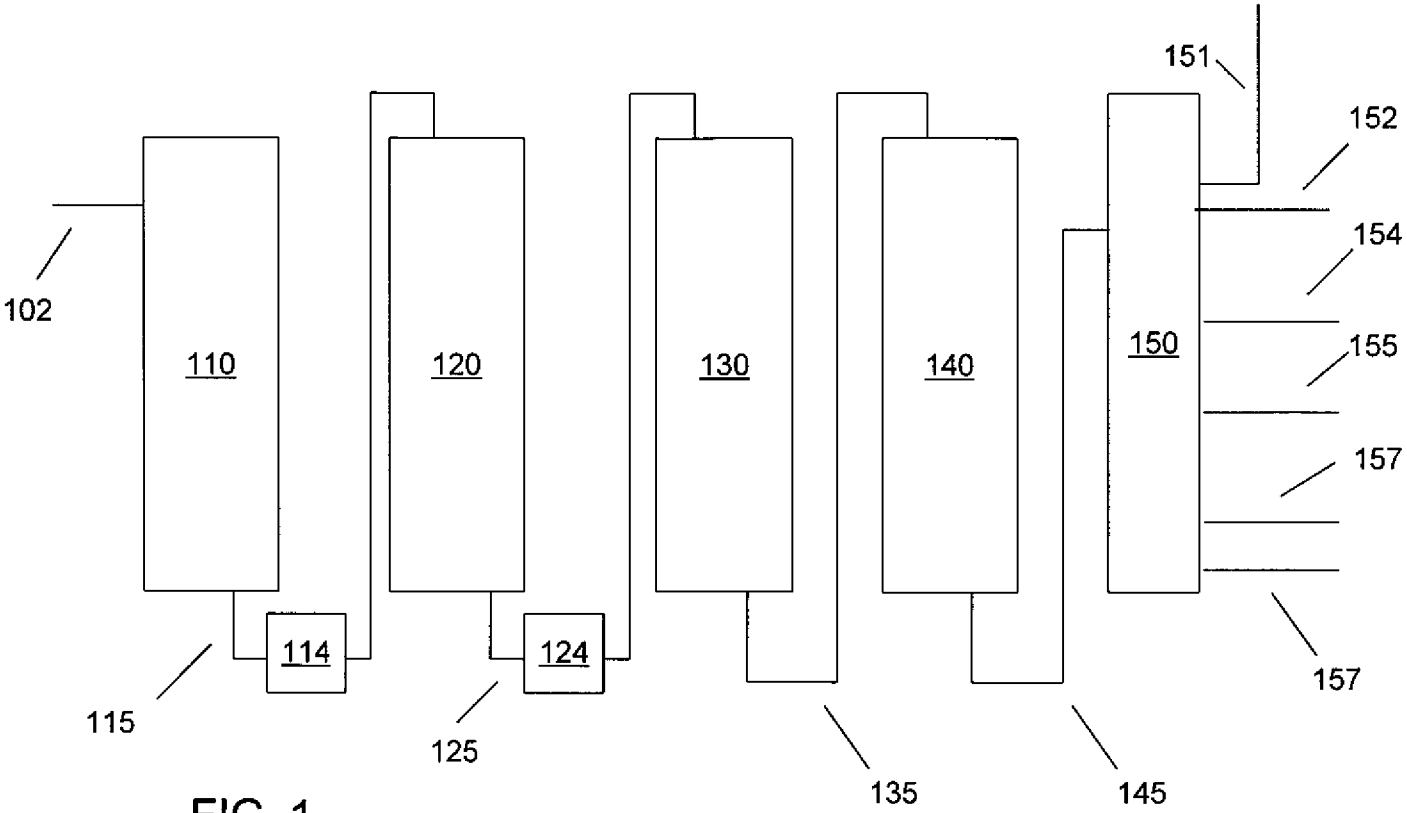
FIG. 1 schematically shows an example of a multi-stage reaction system according to an embodiment of the invention.

All numerical values within the detailed description and the claims herein are modified by "about" "approximately" the indicated value, and take into account experimental error and variations that would be expected by a person having ordinary skill in the art.

Overview

In various embodiments, methods are provided for producing a plurality of lubricant base oil products with an increased overall yield. Prior to the final hydrocracking stage for viscosity index uplift, a feed for making a lubricant base oil is fractionated in order to form at least a feed for making a light lubricant base oil and a feed for making a medium or heavy lubricant base oil. The fractionation cut points are selected to so that the feed fraction for the light lubricant base oil has a higher Noack volatility and a lower viscosity than the desired targets for the light lubricant base oil. The feed fractions for the light lubricant base oil and medium or heavy lubricant base oil are then hydroprocessed separately to achieve desired properties. After hydroprocessing, a portion of the medium or heavy base oil is blended into the light lubricant base oil. This returns the Noack volatility and the viscosity of the blended base oil product to the desired specifications. By incorporating additional light materials in the feed for the light lubricant base oil, processing the feed for the light lubricant base oil separately, and then blending in a portion of the medium or heavy base oil, the overall yield of base oils is increased as compared to hydroprocessing the entire feed without initial fractionation.

Feed Fractionation and Lubricant Base Oil Products

In various embodiments, at least two lubricant base oil products can be made from an initial feed. A first lubricant base oil product can be a lighter base oil. The first lubricant base oil can be a 100N to 300N base oil, such as at least a 150N base oil. The first lubricant base oil can have a viscosity of 2.0 cSt to 5.0 cSt at 100° C., such as at least 3.0 cSt, preferably at least 4.0 cSt, and optionally less than 4.5 cSt or less than 4.0 cSt. The Noack volatility can be from 10.0 to about 18.0, preferably from 12.0 to 16.0. The viscosity index can be at least 85, such as from 95 to 145, or from 100 to 130, preferably at least about 110. The pour point of the first lubricant base oil can be 0° C. or less, such as −10° C., preferably −20° C. or less, or optionally −30° C. or less. Other desired values can be specified, such as a desired pour point, Brookfield viscosity, a mini rotary viscometry value, and/or a cold cranking simulator test value. The second lubricant base oil is a heavier base oil, such as a 250N to 600N base oil, preferably less than 500N. The viscosity of the heavier base oil is from 5.0 cSt to 12.0 cSt at 100° C., such as at least 6.0 cSt. The Noack volatility from is 5.0 to 12.0, such as less than 10.0. The viscosity index can be at least 80, such as from 95 to 145, or from 100 to 130, preferably at least about 110. The Noack volatility of the heavier base oil is lower than the Noack volatility of the lighter base oil, and the viscosity of the heavier base oil at 1.00° C. is greater than the viscosity of the lighter base oil. The pour point of the second lubricant base oil can be 0° C. or less, such as −5° C., preferably −10° C. or less, or optionally −20° C. or less or even −30° C.

Producing a base oil having the desired viscosity and volatility characteristics is controlled in part by fractionation. Conventionally, a feedstock for a lubricant base oil is hydroprocessed to achieve desired cold flow and viscosity index values, followed by fractionation to produce lubricant base oil cuts with desired viscosity and volatility values. The cut point for the fractionation determines the viscosity and volatility of the resulting base oil. Optionally, a fractionation can also occur prior to hydroprocessing.

In various embodiments, a feed for producing multiple lubricant base oils can be fractionated before the final hydrocracking stage. One option is to fractionate prior to any hydrocracking. Another option is to hydrotreat and/or hydrocrack the feed sufficiently to reduce the sulfur and nitrogen content of the feed to a desired level. The feed can then be fractionated, and one or more additional hydrocracking, dewaxing, and hydrofinishing stages can be used to achieve desired levels of viscosity index uplift and reduction in pour point.

During the initial fractionation, the cut points for the lighter base oil are not set to match the desired volatility and viscosity values. Instead, the cut points are set to produce a narrower cut with higher volatility and lower viscosity. As an example, a desired lubricant base oil can have a viscosity of 4.7 cSt at 100° C. and a Noack volatility of 14. In such an example, a fractionation cut point for a lighter base oil according to the invention would be set to produce a viscosity of 4.0 cSt to 4.5 cSt at 100° C. and a Noack volatility of 15 or 16. As a result, the fractionation cut point for the lighter base oil adds a portion of lower boiling molecules that would not be present if the cut point was set for 4.7 cSt at 100° C. and a Noack volatility of 14. For the heavier base oil, the cut point is set to match the desired viscosity and volatility.

After fractionation, the lighter base oil and heavier base oil are hydroprocessed to achieve desired viscosity index and cold flow properties, such as pour point. The hydroprocessing can include, for example, hydrocracking, catalytic dewaxing, and hydrofinishing. The hydroprocessing on each feed fraction can be used to provide desired properties for the particular base oil. For example, the hydroprocessing conditions for the lighter feed fraction can be selected to produce a base oil with a lower pour point and a higher viscosity index as compared to the hydroprocessing conditions for the heavier feed fraction.

A second fractionation can then optionally be used on each hydroprocessed feed fraction to remove any fuels or light ends generated during hydroprocessing. This produces a lighter base oil fraction and a heavier base oil fraction. Because of the cut points used for the initial fractionation, the lighter base oil fraction has a lower viscosity than desired for the final product and a higher Noack volatility than desired for the final product. To achieve the desired viscosity and volatility, a portion of the heavier base oil fraction is blended into the lighter base oil fraction. The amount of heavier base oil blended into the lighter base oil is sufficient to achieve the desired volatility and viscosity values.

The fractionation, hydroprocessing, and blending provided in various embodiments allows for an increase in the overall yield of lubricating base oil from an initial feedstock. During the initial fractionation, selecting a cut point for the lighter base oil to have a higher Noack volatility and a lower viscosity allows a larger portion of the initial feed to be included as part of the lubricating oil by incorporating lighter molecules. After hydroprocessing, these lighter molecules are offset by blending a portion of the heavier base oil into the lighter base oil. This results in a cross section of the heavier base oil being added to the lighter base oil. Such a cross section includes heavier molecules that would normally not be present in a lighter base oil formed only by fractionation of a feed. It is believed that these heavier molecules offset the additional lighter molecules that were retained in the feed for the lighter lubricating base oil at fractionation. This allows the lighter lubricating base oil to meet desired viscosity and volatility specifications while incorporating a greater portion of the feedstock.

In various embodiments, a fractionation for a lighter base oil can produce a lighter fraction with a Noack volatility at least 0.5 greater than a desired volatility in the final base oil, or at least 1.0 greater, or at least 1.5 greater, or at least 2.0 greater. A fractionation for a lighter base oil can produce a lighter fraction with a viscosity at 100° C. that is at least 0.1 cSt lower than a desired viscosity, or at least 0.3 cSt lower, or at least 0.5 cSt lower. The difference in Noack volatility and viscosity between the cut from fractionation and the desired product is dependent on the amount of the heavier base oil that is blended into the lighter base oil to form a blended base oil product. Typically, blending in a larger amount of the heavier base oil will result in a greater difference between the viscosity and volatility of the blended product versus the lighter base oil prior to blending. The amount of heavier base oil in the blended product can be at least 3 wt % or at least 5 wt %. Typically, the amount of heavier base oil in the blended product will be less than 30 wt %, such as less than 25 wt %. If too much of the heavier base oil is included in the blended product, the cold flow properties and/or other characteristics of the blended base oil product may be adversely affected.

Feedstocks

A wide range of petroleum and chemical feedstocks can be hydroprocessed in accordance with the present invention. Suitable feedstocks include whole and reduced petroleum crudes, atmospheric and vacuum residua, propane deasphalted residua, brightstock, cycle oils, FCC tower bottoms, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

Typical feeds include, for example, feeds with an initial boiling point of at least about 650° F. (343° C.), or at least about 700° F. (371° C.), or at least about 750° F. (399° C.). Alternatively, a feed may be characterized using a T5 boiling point, such as a feed with a T5 boiling point of at least about 650° F. (343° C.), or at least about 700° F. (371° C.), or at least about 750° F. (399° C.). Typical feeds include, for example, feeds with a final boiling point of about 1150° F. (621° C.), or about 1100° F. (593° C.) or less, or about 1050° F. (566° C.) or less. Alternatively, a feed may be characterized using a T95 boiling point, such as a feed with a T95 boiling point of about 1150° F. (621° C.), or about 1100° F. (593° C.) or less, or about 1050° F. (566° C.) or less. It is noted that feeds with still lower initial boiling points and/or T5 boiling points may also be suitable, so long as sufficient higher boiling material is available so that the overall nature of the process is a lubricant base oil production process.

In embodiments involving an initial sulfur removal stage prior to hydrocracking, the sulfur content of the feed can be at least 100 ppm by weight of sulfur, or at least 1000 wppm, or at least 2000 wppm, or at least 4000 wppm, or at least 10,000 wppm, or at least about 20,000 wppm. In other embodiments, including some embodiments where a previously hydrotreated and/or hydrocracked feed is used, the sulfur content can be about 2000 wppm or less, or about 1000 wppm or less, or about 500 wppm or less, or about 100 wppm or less.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil.

Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleerochrysis carterae, Prymnesium parvum, Tetraselmis chui*, and *Chlamydomonas reinhardtii*.

The biocomponent feeds usable in the present invention can include any of those which comprise primarily triglycerides and free fatty acids (FFAs). The triglycerides and FFAs typically contain aliphatic hydrocarbon chains in their structure having from 8 to 36 carbons, preferably from 10 to 26 carbons, for example from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority greater than 50%) of the triglyceride present in the lipid material can be comprised of $C_{10}$ to $C_{26}$, for example $C_{12}$ to $C_{18}$, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

Biocomponent based feedstreams typically have relatively low nitrogen and sulfur contents. For example, a biocomponent based feedstream can contain up to about 500 wppm nitrogen, for example up to about 300 wppm nitrogen or up to about 100 wpm nitrogen. Instead of nitrogen and/or sulfur, the primary heteroatom component in biocomponent feeds is oxygen. Biocomponent diesel boiling range feedstreams, e.g., can include up to about 10 wt % oxygen, up to about 12 wt % oxygen, or up to about 14 wt % oxygen. Suitable biocomponent diesel boiling range feedstreams, prior to hydrotreatment, can include at least about 5 wt % oxygen, for example at least about 8 wt % oxygen.

Alternatively, a feed of biocomponent origin can be used that has been previously hydrotreated. This can be a hydrotreated vegetable oil feed, a hydrotreated fatty acid alkyl ester feed, or another type of hydrotreated biocomponent feed. A hydrotreated biocomponent feed can be a biocomponent feed that has been previously hydroprocessed to reduce the oxygen content of the feed to about 500 wppm or less, for example to about 200 wppm or less or to about 100 wppm or less. Correspondingly, a biocomponent feed can be hydrotreated to reduce the oxygen content of the feed, prior to other optional hydroprocessing to about 500 wppm or less, for example to about 200 wpm or less or to about 100 wppm or less. Additionally or alternately, a biocomponent feed can be blended with a mineral feed, so that the blended feed can be tailored to have an oxygen content of about 500 wppm or less, for example about 200 wppm or less or about 100 wppm or less. In embodiments where at least a portion of the feed is of a biocomponent origin, that portion can be at least about 2 wt %, for example at least about 5 wt %, at least about 10 wt %, at least about 20 wt %, at least about 25 wt %, at least about 35 wt %, at least about 50 wt %, at least about 60 wt %, or at least about 75 wt %. Additionally or alternately, the biocomponent portion can be about 75 wt % or less, for example about 60 wt % or less, about 50 wt % or less, about 35 wt %, or less, about 25 wt % or less, about 20 wt % or less, about 10 wt % or less, or about 5 wt % or less.

The content of sulfur, nitrogen, and oxygen in a feedstock created by blending two or more feedstocks can typically be determined using a weighted average based on the blended feeds. For example, a mineral feed and a biocomponent feed can be blended in a ratio of about 80 wt % mineral feed and about 20 wt % biocomponent feed. In such a scenario, if the mineral feed has a sulfur content of about 1000 wppm, and the biocomponent feed has a sulfur content of about 10 wppm, the resulting blended feed could be expected to have a sulfur content of about 802 wppm.

Hydroprocessing for Lubricant Base Stock Production

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

Various types of hydroprocessing can be used in the production of lubricant base stocks. Typical processes include a hydrocracking process to provide uplift in the viscosity index (VI) of the feed. The hydrocracked feed can then be dewaxed to improve cold flow properties, such as pour point or cloud point. The hydrocracked, dewaxed feed can then be hydrofinished, for example, to remove aromatics from the lubricant base stock product. This can be valuable for removing compounds that are considered hazardous under various regulations. In addition to the above, a preliminary hydrotreatment and/or hydrocracking stage can also be used for contaminant removal.

FIG. 1 shows a schematic example of a process train for producing lubricant oil base stocks from a feed. In the embodiment shown in FIG. 1, the process train represents the process train for processing one of the two feedstock portions after fractionation. In order to process both the lighter and the heavier feedstock portions, tank storage can be used to hold one portion while the other portion is being processed. Alternatively, parallel process trains can be used to process the lighter and heavier feedstock portions. The conditions for processing each feedstock portion can be selected to achieve the desired viscosity index and cold flow properties. In the embodiment shown in FIG. 1, a feedstock 102 is introduced into an optional preliminary hydrotreating and/or hydrocracking stage 110. This optional hydrotreating and/or hydrocracking stage can be used to reduce the amount of sulfur or nitrogen in the feed to a lower level. Removing sulfur and/or nitrogen from the feed can be beneficial for avoiding deactivation of hydrocracking catalyst in a later hydrocracking stage, such as hydrocracking stage 120. Alternatively, hydrocracking stage 120 may be able to provide sufficient contaminant removal preliminary hydrotreating or hydrocracking stage 110 is not necessary. A gas-liquid separator 114 or 124 is shown after both stage 110 and stage 120. The separators are also optional, depending on the desired configuration. At some point in the reaction system, removal of gas phase $H_2S$ or $NH_3$ is typically beneficial to avoid poisoning of downstream catalysts. Thus, at least one separator will typically be present prior to introducing a hydrocracked effluent into a dewaxing stage.

In the embodiment shown in FIG. 1, hydrocracking stage 120 receives the hydrotreated and/or hydrocracked effluent 115 from stage 110, possibly after passing through separator 114. Alternatively, feedstock 102 may enter hydrocracking stage 120 directly, such as by being passed into hydrocracking stage 120 as the output from a fractionator, vacuum distillation unit, or some other refinery process. Hydrocracking stage 120 can be operated under effective conditions for improving the VI of the feed to a desired level, as well as performing any additional contaminant removal.

After exiting hydrocracking stage 120, the (optionally separated) effluent 125 is passed into a dewaxing stage 130 in order to improve cold flow properties of the hydrocracked effluent. The hydrocracked, dewaxed effluent 135 is then passed into an optional hydrofinishing stage 140. The resulting effluent 145 can then be fractionated 150 to form various desired fractions, such as one or more lubricant base oil fractions 157, which can also be referred to as hydroprocessed feed fractions. Because the feed was fractionated prior to hydroprocessing, the fractionator 150 may only produce one lubricant base oil fraction 157. Additionally, fractionator 150 can also generate multiple fuel fractions, such as a naphtha fraction 152, a premium diesel or distillate fraction 154, and an additional diesel fraction 155. A light ends fraction 151 will also typically be removed from fractionator 150. More or different fractions can be generated by selecting different cut points in the fractionator.

Figure 2:
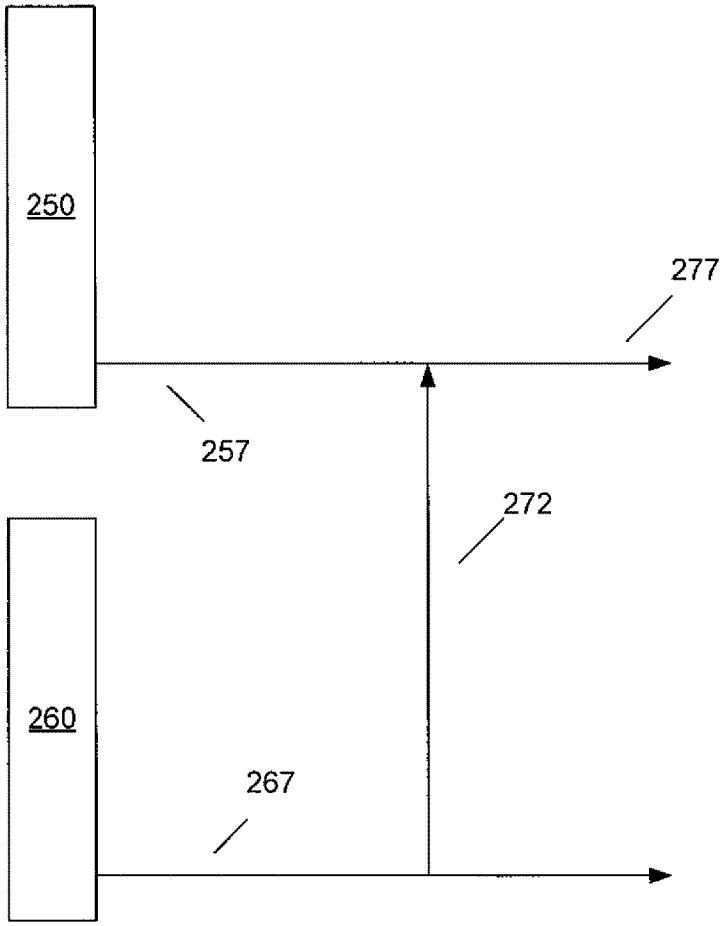
FIG. 2 schematically shows an example of another multi-stage reaction system according to an embodiment of the invention.

FIG. 2 shows an example of a final fractionator 250 for making a light hydroprocessed feed fraction 257 and a final fractionator 260 for a medium hydroprocessed feed fraction 267. In the embodiment shown in FIG. 2, the light and medium hydroprocessed feed fractions are processed in parallel. A portion 272 of the medium hydroprocessed feed fraction 267 is blended with light hydroprocessed feed fraction 257 to make a blended product 277. The blended product 277 and the remaining portion of medium hydroprocessed feed fraction 267 represent the base oil products generated in this configuration.

Hydrotreatment Conditions

Hydrotreatment is typically used to reduce the sulfur, nitrogen, and aromatic content of a feed. Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.2 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreating catalysts are typically those containing Group VIB metals, such as molybdenum and/or tungsten, and non-noble Group VIII metals, such as, iron, cobalt and nickel and mixtures thereof. These metals or mixtures of metals are typically present as oxides or sulfides on refractory metal oxide supports. Suitable metal oxide supports include low acidic oxides such as silica, alumina or titania. Preferred aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support. Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina. Alternatively, the hydrotreating catalyst can be a bulk metal catalyst, or a combination of stacked beds of supported and bulk metal catalyst.

Hydrocracking Conditions

Hydrocracking catalysts typically contain sulfided base metals on acidic supports, such as amorphous silica alumina, cracking zeolites such as USY, or acidified alumina. Often these acidic supports are mixed or hound with other metal oxides such as alumina, titania or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various embodiments, the conditions selected for hydrocracking for lubricant base stock production can depend on the desired level of conversion, the level of contaminants in the input feed to the hydrocracking stage, and potentially other factors. A hydrocracking process can be carried out at temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), liquid hourly space velocities of from about 0.2 $h^{-1}$ to about 2 $h^{-1}$ and hydrogen treat gas rates of from about 213 $m^3/m^3$ to about 1068 $m^3/m^3$ (1200 SCF/B to 6000 SCF/B).

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

Dewaxing Process

In various embodiments, a dewaxing catalyst is also included. Typically, the dewaxing catalyst is located in a bed downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. The dewaxing catalyst can be located in the same reactor as at least a portion of the hydrocracking catalyst in a stage. Alternatively, the effluent from a reactor containing hydrocracking catalyst, possibly after a gas-liquid separation, can be fed into a separate stage or reactor containing the dewaxing catalyst.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-1.1, ZSM-48, ZSM-23, and ZSM-22. Preferred materials are EU-2, EU-11, ZBM-30, ZSM-48, or ZSM-23, ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

In various embodiments, the catalysts according to the invention further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 0.5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area hinder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

In yet another embodiment, the dewaxing catalyst is self-bound and does not contain a binder.

A bound dewaxing catalyst can also be characterized by comparing the micropore (or zeolite) surface area of the catalyst with the total surface area of the catalyst. These surface areas can be calculated based on analysis of nitrogen porosimetry data using the BET method for surface area measurement. Previous work has shown that the amount of zeolite content versus binder content in catalyst can be determined from BET measurements (see, e.g., Johnson, M. F. L., *Jour. Catal.*, (1978) 52, 425). The micropore surface area of a catalyst refers to the amount of catalyst surface area provided due to the molecular sieve and/or the pores in the catalyst in the BET measurements. The total surface area represents the micropore surface plus the external surface area of the bound catalyst. In one embodiment, the percentage of micropore surface area relative to the total surface area of a bound catalyst can be at least about 35%, for example at least about 38%, at least about 40%, or at least about 45%. Additionally or alternately, the percentage of micropore surface area relative to total surface area can be about 65% or less, for example about 60% or less, about 55% or less, or about 50% or less.

Additionally or alternately, the dewaxing catalyst can comprise, consist essentially of, or be a catalyst that has not been dealuminated. Further additionally or alternately, the binder for the catalyst can include a mixture of binder materials containing alumina.

Process conditions in a catalytic dewaxing zone in a sour environment can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, a liquid hourly space velocity of from 0.2 $hr^{-}$ to 10 $hr^{-1}$, preferably 0.5 $hr^{-1}$ to 3.0 $hr^{-1}$, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). These latter conditions may be suitable, for example, if the dewaxing stage is operating under sour conditions.

Additionally or alternately, the conditions for dewaxing can be selected based on the conditions for a preceeding reaction in the stage, such as hydrocracking conditions or hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is about the same as the outlet temperature of the prior catalyst bed. Another option can be to use a quench to have a temperature at the beginning of the dewaxing catalyst bed that is at least about 10° F. (6° C.) lower than the prior catalyst bed, or at least about 20° F. (11° C.) lower, or at least about 30° F. (16° C.) lower, or at least about 40° F. (21° C.) lower.

Hydrofinishing and/or Aromatic Saturation Process

In various embodiments, a hydrofinishing and/or aromatic saturation stage is also be provided. The hydrofinishing and/or aromatic saturation can occur after the last hydrocracking or dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on one or more lubricant base stock portions. Alternatively, the entire effluent from the last hydrocracking ter dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof in an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt % or greater based on catalyst. Suitable metal oxide supports include low acidic oxides such as silica, alumina, silica-aluminas or titanic, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are rnesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Examples of Forming a Light and Medium Lubricating Base Oil

The following examples provide results of model calculations regarding production of lubricating base oils from a feedstock. In both of the following examples, the same initial feedstock was modeled. Hydroprocessing conditions were modeled to achieve the desired viscosity and volatility values for the model products. For ease of comparison, in each example a fractionation was performed prior to hydroprocessing.

In the comparative example, an initial fractionation was performed to provide the feedstock for a light lubricating base oil and a medium lubricating base oil. The fractionation for the lighter feed fraction was performed in a conventional manner to match a desired viscosity of 4.7 cSt at 100° C. and Noack volatility of 14 for a 150N base oil. The fractionation for the heavier feed fraction was performed to match a desired viscosity of 6.2 cSt at 100° C. and Noack volatility of 8.2 for a 260N base oil. The light base oil was hydroprocessed to achieve a viscosity index of 116, while the medium base oil was hydroprocessed to a viscosity index of 112.

To facilitate comparison, the simulation was based on using 1000 barrels per day of the lighter feed fraction and 1000 barrels per day of the heavier feed fraction. After hydroprocessing, a second fractionation was performed to separate out a light lubricant base oil product from diesel, naphtha, and light ends generated during the hydroprocessing. The resulting light lubricant base oil product corresponded to 626 barrels per day. After similar fractionation of the hydroprocessed heavier feed fraction, the resulting medium lubricant base oil product corresponded to 710 barrels per day.

In an embodiment according to the invention, processes similar to the above comparative example were simulated. However, the cut point for the lighter feed fraction was modified to correspond to a feed with a viscosity between 4.0 and 4.5 cSt at 100° C., as opposed to the desired 4.7 cSt. The Noack volatility for the lighter feed fraction was between 15 and 16, as opposed to the desired 14. This change in the lighter feed fraction did not change the composition of the heavier feed fraction.

Hydroprocessing was then simulated using 1000 barrels per day of each feed fraction as the input. The conditions for the heavier feed fraction were the same as in the comparative example, resulting in the same yield of 710 barrels per day for the medium base oil product. The hydroprocessing conditions for the lighter feed fraction were modified relative to the comparative example in order to achieve the desired viscosity index value of 116. The resulting light base oil product corresponded to 642 barrels per day. Thus, an additional 16 barrels per day of product are generated. However, the volatility and viscosity specifications for the light base oil product do not match the comparative example values. In order to achieve the desired viscosity and volatility, the model included blending a portion of the medium base oil with the lighter base oil. This resulted in a blended base oil product that included 13 wt % of the medium base oil. The blended base oil product had the desired viscosity of 4.7 cSt at 100° C. and the desired Noack volatility of 14. It is noted that while the simulations predict an overall yield increase of 16 barrels per day for each 1000 barrels processed (1.6% overall yield increase), the ratio of the individual yields of base oil products is modified. In the example simulation according to the invention, a larger proportion of the overall base oil yield corresponds to the light lubricant base oil.

ADDITIONAL EMBODIMENTS

Embodiment 1

A method for producing a lubricant base oil, comprising: fractionating a feedstock to form at least a first feed fraction and a second feed fraction; hydroprocessing the first feed fraction to increase the viscosity index to at least about 85 and reduce the pour point to about −10° C. or less; hydroprocessing the second feed fraction to increase the viscosity index to at least about 80 and reduce the pour point to about −5° C. or less; fractionating the hydroprocessed first feed fraction to form a first product fraction having a viscosity at 100° C. of at least about 1.5 cSt and a Noack volatility of less than about 20.0; fractionating the hydroprocessed second feed fraction to form a second product fraction having a viscosity at 100° C. of about 5.0 cSt to about 12.0 cSt and a Noack volatility of about 5.0 to about 10.0; and blending a portion of the second hydroprocessed feed fraction with the first hydroprocessed feed fraction to form a blended product fraction, the blended product fraction comprising about 30 wt % or less of the second hydroprocessed feed fraction, the blended product fraction having a viscosity at 100° C. of about 2.0 cSt to about 5.0 cSt and a Noack volatility of about 10.0 to about 18.0, the viscosity of the blended product fraction at 100° C. being greater than the viscosity of the first hydroprocessed feed fraction by at least about 0.1 cSt, the Noack volatility of the blended product fraction being less than the Noack volatility of the first feedstock fraction by at least about 0.5.

Embodiment 2

The method of embodiment 1, wherein the pour point of the blended product fraction is about −15° C. or less, or preferably about −20° C. or less, or more preferably about −25° C. or less.

Embodiment 3

The method of any of the above embodiments, wherein the pour point of the second hydroprocessed feed fraction is about −10° C. or less, or preferably about −15° C. or less, or more preferably about −25° C. or less.

Embodiment 4

The method of any of the above embodiments, wherein the viscosity index of the first hydroprocessed feed fraction is at least about 95, preferably from about 100 to about 130, and more preferably at least about 110.

Embodiment 5

The method of any of the above embodiments, wherein the viscosity index of the second hydroprocessed feed fraction is at least about 95, preferably from about 100 to about 130, and more preferably at least about 110.

Embodiment 6

The method of any of the above embodiments, wherein the viscosity index of the second hydroprocessed feed fraction is less than the viscosity index of the first hydroprocessed feed fraction.

Embodiment 7

The method of any of the above embodiments, wherein the viscosity at 100° C. of the blended product fraction is at least about 0.3 cSt greater than the viscosity of the first hydroprocessed feed fraction, preferably at least about 0.5 cSt greater.

Embodiment 8

The method of any of the above embodiments, wherein the blended product fraction comprises from about 3 wt % to about 30 wt % of the second hydroprocessed feed fraction, preferably from about 5 wt % to 25 wt %, and more preferably from about 10 wt % to about 20 wt %.

Embodiment 9

The method of any of the above embodiments, wherein the Noack volatility of the blended product fraction is at least about 1.0 less than the Noack volatility of the first hydroprocessed fraction, preferably at least about 1.5 less or at least 2.0 less.

Embodiment 10

The method of any of the above embodiments, wherein hydroprocessing the first feed fraction comprises: hydrocracking the first feed fraction under first effective hydrocracking conditions; dewaxing the hydrocracked first feed fraction under first effective catalytic dewaxing conditions; and optionally hydrofinishing the hydrocracked, dewaxed first feed fraction under first effective hydrofinishing conditions.

Embodiment 11

The method of any of the above embodiments, wherein hydroprocessing the second feed fraction comprises: hydrocracking the second feed fraction under second effective hydrocracking conditions; dewaxing the hydrocracked second feed fraction under second effective catalytic dewaxing conditions; and optionally hydrofinishing the hydrocracked, dewaxed second feed fraction under second effective hydrofinishing conditions.

Embodiment 12

The method of embodiment 10 or 11, wherein at least one of the first effective hydrocracking conditions or the second effective hydrocracking conditions include a temperature of about 550° F. (288° C.) to about 840° F. (449° C.), preferably about 600° F. (343° C.) to about 815° F. (435° C.); a hydrogen partial pressure of about 250 psig (1.8 MPag) to about 5000 psig (34.6 MPag), preferably about 500 psig (3.5 MPag) to about 3000 psig (20.9 MPag); a liquid hourly space velocity of from about 0.05 $hr^{-1}$ to about 10 $h^{-1}$, preferably about 0.2 $h^{-1}$ to about 2 $h^{-1}$; and a hydrogen treat gas rate of about 35.6 $m^3/m^3$ (200 SCF/B) to 1781 $m^3/m^3$ (10,000 SCF/B), preferably about 213 $m^3/m^3$ (1200 SCF/B) to about 1068 $m^3/m^3$ (6000 SCF/B).

Embodiment 13

The method of any of embodiments 10-12, wherein at least one of the first effective dewaxing conditions or the second effective dewaxing conditions include a temperature of about 200° C. to about 450° C., preferably about 270° C. to about 400° C.; a hydrogen partial pressure of from 1.8 MPag (250 psig) to 34.6 MPag (5000 psig), preferably 4.8 MPag to 20.8 MPag; a liquid hourly space velocity of from 0.2 hr to 10, preferably 0.5 $hr^{-1}$ to 3.0 $hr^{-1}$; and a hydrogen circulation rate of from 35.6 $m^3/m^3$ (200 SCF/B) to 1781

$m^3/m^3$ (10,000 SCF/B), preferably 178 $m^3/m^3$ (1000 SCF/B) to 890.6 $m^3/m^3$ (5000 SCF/B).

Embodiment 14

The method of any of embodiments 10-13, wherein at least one of the first effective hydrofinishing conditions or the second effective hydrofinishing conditions include a temperature of about 125° C. to about 425° C., preferably about 180° C. to about 2.80° C.; a hydrogen partial pressure from about 500 psig (3.4 MPa) to about 3000 psig (20.7 MPa), preferably about 1500 psig (10.3 MPa) to about 2500 psig (17.2 MPa); and a liquid hourly space velocity from about 0.1 hr about 5 $hr^{-1}$ LHSV, preferably about 0.5 $hr^{-1}$ to about 1.5 $hr^{-1}$; and a hydrogen treat gas rate of about 35.6 $m^3/m^3$ (200 SCF/B) to 1781 $m^3/m^3$ (10,000 SCF/B).

Embodiment 15

The method of any of embodiments 10-14, further comprising hydrotreating at least one of the first feed fraction or the second feed fraction under effective hydrotreating conditions including a temperature of about 200° C. to 450° C., preferably 315° C. to 425° C.; a hydrogen partial pressure of about 250 psig (1.8 MPag) to about 5000 psig (34.6 MPag), preferably about 300 psig (2.1 MPag) to about 3000 psig (20.8 MPag); a liquid hourly space velocity of about 0.2 $hr^{-1}$ to about 10 $hr^{-1}$; and a hydrogen treat rate of about 200 SCF/B (35.6 $m^3/m^3$) to about 10,000 SCF/B (1781 $tn^3$), preferably about 500 SCF/B (89 $m^3/m^3$) to about 10,000 SCF/B (1781 $m^3/m^3$).

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for producing a lubricant base oil, comprising:

fractionating a feedstock to form at least a first feed fraction and a second feed fraction;

hydroprocessing the first feed fraction to increase the viscosity index to at least about 85 and reduce the pour point to about −10° C. or less;

hydroprocessing the second feed fraction to increase the viscosity index least about 80 and reduce the pour point to about −5° C. or less;

fractionating the hydroprocessed first feed fraction to form a first product fraction having a viscosity at 100° C. of at least about 1.5 cSt and a Noack volatility of less than about 20.0;

fractionating the hydroprocessed second feed fraction to form a second product fraction having a viscosity at 100° C. of about 5.0 cSt to about 12.0 cSt and a Noack volatility of about 5.0 to about 10.0; and blending a portion of the second hydroprocessed feed fraction with the first hydroprocessed feed fraction to form a blended product fraction, the blended product fraction comprising about 30 wt % or less of the second hydroprocessed feed fraction, the blended product fraction having a viscosity at 100° C. of about 2.0 cSt to about 5.0 cSt and a Noack volatility of about 10.0 to about 18.0, the viscosity of the blended product fraction at 100° C. being greater than the viscosity of the first hydroprocessed feed fraction by at least about 0.1 cSt, the Noack volatility of the blended product fraction being less than the Noack volatility of the first feedstock fraction by at least about 0.5; and wherein the overall yield of the lubricating base oil is increased by about 1.6% compared to hydroprocessing the feedstock without the initial fractionation step.

2. The method of claim 1, wherein the pour point of the blended product fraction is about −15° C. or less.

3. The method of any of the above claims, wherein the pour point of the second hydroprocessed feed fraction is about −10° C. or less.

4. The method of any of the above claims, wherein the viscosity index of the first hydroprocessed feed fraction is at least about 95.

5. The method of any of the above claims, wherein the viscosity index of the second hydroprocessed feed fraction is at least about 95.

6. The method of any of the above claims, wherein the viscosity index of the second hydroprocessed feed fraction is less than the viscosity index of the first hydroprocessed feed fraction.

7. The method of any of the above claims, wherein the viscosity at 100° C. of the blended product fraction is at least about 0.3 cSt greater than the viscosity of the first hydroprocessed feed fraction.

8. The method of any of the above claims, wherein the blended product fraction comprises from about 3 wt % to about 30 wt % of the second hydroprocessed feed fraction.

9. The method of any of the above claims, wherein the Noack volatility of the blended product fraction is at least about 1.0 less than the Noack volatility of the first hydroprocessed fraction.

10. The method of any of the above claims, wherein hydroprocessing the first feed fraction comprises:

hydrocracking the first feed fraction under first effective hydrocracking conditions;

dewaxing the hydrocracked first feed fraction under first effective catalytic dewaxing conditions; and optionally hydrofinishing the hydrocracked, dewaxed first feed fraction under first effective hydrofinishing conditions.

11. The method of any of the above claims, wherein hydroprocessing the second feed fraction comprises:

hydrocracking the second feed fraction under second effective hydrocracking conditions;

dewaxing the hydrocracked second feed fraction under second effective catalytic dewaxing conditions; and optionally hydrofinishing the hydrocracked, dewaxed second feed fraction under second effective hydrofinishing conditions.

12. The method of claim 10 or 11, wherein at least one of the first effective hydrocracking conditions or the second effective hydrocracking conditions include a temperature of about 550° F. (288° C.) to about 840° F. (449° C.), a hydrogen partial pressure of about 250 psig (1.8 MPag) to about 5000 psig (34.6 MPag), a liquid hourly space velocity of from about 0.05 $h^{-1}$ to about 10 $h^{-1}$, and a hydrogen treat gas rate of about 35.6 $m^3/m^3$ (200 SCF/B) to 1781 $m^3/m^3$ (10,000 SCF/B).

13. The method of any of claims 10-12, wherein at least one of the first effective dewaxing conditions or the second effective dewaxing conditions include a temperature of about 200° C. to about 450° C., a hydrogen partial pressure of from 1.8 MPag (250 psig) to 34.6 MPag (5000 psig), a liquid hourly space velocity of from 0.2 $hr^{-1}$ to 10 $hr^{-1}$, and a hydrogen circulation rate of from 35.6 $m^3/m^3$ (200 SCF/B) to 1781 $m^3/m^3$ (10,000 SCF/B).

14. The method of any of claims 10-13, wherein at least one of the first effective hydrofinishing conditions or the second effective hydrofinishing conditions include a temperature of about 125° C. to about 425° C., a hydrogen partial pressure from about 500 psig (3.4 MPa) to about 3000 psig (20.7 MPa), and a liquid hourly space velocity from about 0.1 $h^{-1}$ to about 5 $hr^{-1}$ LHSV, and a hydrogen treat gas rate of about 35.6 $m^3/m^3$ (200 SCF/B) to 1781 $m^3/m^3$ (10,000 SCF/B).

15. The method of any of claims 10-14, further comprising hydrotreating at least one of the first feed fraction or the second feed fraction under effective hydrotreating conditions including a temperature of about 200° C. to 450° C., a hydrogen partial pressure of about 250 psig (1.8 MPag) to about 5000 psig (34.6 MPag), a liquid hourly space velocity of about 0.2 $hr^{-1}$ to about 10 $hr^{-1}$; and a hydrogen treat rate of about 200 SCF/B (35.6 $m^3/m^3$) to about 10,000 SCF/B (1781 $m^3/m^3$).

* * * * *